US006592387B2

(12) United States Patent
Komenda et al.

(10) Patent No.: US 6,592,387 B2
(45) Date of Patent: Jul. 15, 2003

(54) SPRING-LOADED CONNECTOR SETUP FOR BLIND MATING AND METHOD FOR USING THE SAME

(75) Inventors: Vernon A. Komenda, Scottsdale, AZ (US); John H. Eller, Jr., Glendale, AZ (US); Gary O. Larson, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/749,370

(22) Filed: Dec. 26, 2000

(65) Prior Publication Data

US 2002/0081881 A1 Jun. 27, 2002

(51) Int. Cl.[7] ..... H01R 13/64
(52) U.S. Cl. ..... 439/247; 439/248
(58) Field of Search ..... 439/247, 248, 439/246, 249–252, 378, 64, 374, 377–381, 681, 564, 573, 362

(56) References Cited

U.S. PATENT DOCUMENTS

| | | | | | |
|---|---|---|---|---|---|
| 4,470,100 | A | * | 9/1984 | Rebaudo et al. | 361/613 |
| 4,921,435 | A | | 5/1990 | Kane et al. | 439/248 |
| 5,092,774 | A | * | 3/1992 | Milan | 439/66 |
| 5,125,849 | A | * | 6/1992 | Briggs et al. | 439/378 |
| 5,391,091 | A | * | 2/1995 | Nations | 439/387 |
| 5,397,244 | A | * | 3/1995 | Generoli et al. | 439/248 |
| 5,538,809 | A | * | 7/1996 | Bittihn et al. | 429/120 |
| 5,570,270 | A | | 10/1996 | Naedel et al. | 361/687 |
| 5,931,688 | A | | 8/1999 | Hasz et al. | 439/247 |
| 6,007,360 | A | * | 12/1999 | Wu et al. | 439/350 |
| 6,346,007 | B2 | * | 2/2002 | Yokoi | 439/564 |

FOREIGN PATENT DOCUMENTS

| | | | |
|---|---|---|---|
| EP | 0753905 A | | 1/1997 |
| JP | 6-60935 | * | 3/1994 |

* cited by examiner

*Primary Examiner*—Renee Luebke
*Assistant Examiner*—Phuongchi Nguyen

(57) ABSTRACT

A connector setup is disclosed where one connector can be blind mated to another connector. In a fixed panel, a connector is spring mounted upon the fixed panel such that the connector has freedom of movement in all directions. In addition, the springs are configured so as to provide enough force to mate the connector with a mating connector. Either connector can be mounted between guide pins. The corresponding connector would then be mounted between guide holes. When the module upon which one of the connectors is mounted is slid into the fixed panel, the guide pins interact with the guide holes so as to properly position the connectors in relation to each other. The springs, in addition to providing enough force to mate the connectors, also allows the connector on the panel to float within its mount, permitting the connector to be optimally positioned for mating purposes.

17 Claims, 7 Drawing Sheets

SPRING-LOADED CONNECTOR SETUP FOR BLIND MATING AND METHOD FOR USING THE SAME

BACKGROUND

1. Technical Field

The present invention is related to the interconnection of electronic devices. More particularly, this invention is related to a mounting scheme that allows the blind mating of electrical connectors in a tray to electrical connectors in a module that is inserted into the tray.

2. Background Information

Electrical connectors are used to interconnect electrical devices. There are many different types of electrical connectors in use today. For example, D-sub connectors are well-known in the part: they are very common, for example, in personal computers. A typical personal computer system contains several D-sub connectors, including serial ports, parallel printer ports, connections for a monitor, and game ports.

The operation of prior art D-sub connectors is shown in FIG. 1. FIG. 1 shows an exemplary pair of D-sub connectors that mate with each other. Female connector 100 is a connector with fifteen holes 102. Each hole 102 may be connected to a lead to transmit and receive signals. Flange 104 surrounds the holes. Male connector 110 is a connector has fifteen pins 112. It should be understood that female connector 100 need not have fifteen holes and male connector need not have fifteen pins. D-sub connectors are available with a wide range in the number of holes and pins available: 9-pin connectors and 25-pin connectors are also common. Each hole 102 may be connected to a lead to transmit and receive signals. Flange 114 surrounds the pins.

To establish a connection between female connector 100 and male connector 110, one typically places flange 114 of male connector 110 such that it surrounds flange 104 of female connector 100 so that pins 112 are aligned with holes 102. When male connector 110 is coupled to female connector 100, several lines of communication will be established through a single connector. Typically, screws 116 and 118 may be provided in proximity with male connector 110 (e.g., within approximately 1 cm) such that screws 116 and 118 fit into nuts 106 and 108, which are in proximity with female connector 100. Screws 116 and 118 can be secured with nuts 106 and 108 so as to prevent an accidental disconnection.

Typically, after a user connects the D-sub connectors together, one can tighten the connection using screws. This tightening ensures that the connection is secure and the connection will not terminate inadvertently.

In certain situations, however, one is not able to manually secure such a connection. For example, certain aircraft systems, such as avionics and communications hardware, may be placed in modules that are inserted into trays contained that are located inside panels located in various areas of the aircraft, including the cockpit. The construction of these modules usually places connectors at the rear of the modules. The corresponding connectors are located at the rear of the tray in a wiring harness. Because of the placement of these connectors, access to the connectors may be restricted.

In an aircraft, modules are typically inserted into trays that are fixed in the cockpit and various other areas of the aircraft. FIG. 2 illustrates an exemplary tray 200 into which a module is inserted. Tray 200 includes rear plate 210. Attached to rear plate 210 is connector 212. It should be noted that a rear plate may contain a plurality of connectors. To simplify the illustration of the tray, however, only one connector has been illustrated in FIG. 2.

Referring now to FIG. 3, module 300 is illustrated as containing a display 302. It should be understood, however, that there are many different types of modules with many different types of functions available. The modules typically contain one or more connectors located at the rear of the modules, such as connector 304. Connector 304 connects with connector 212, located on rear plate 210 of tray 200. In order to couple connector 304 with connector 212, module 300 is inserted into tray 200.

One prior art method of inserting a module into a tray is as follows. A technician pulls a portion of the wiring harness out with the module and manually connects and secures the cables to the module. Thereafter, the module would be inserted into the tray. This can be a tedious process that may lead to several problems. For example, in pulling out the wiring harness to make the connection and inserting the module into the tray, it is possible to bend or break the cables. In addition, if the wiring harness is not correctly placed back into the tray, the module may not insert fully into the tray. Furthermore, the designers of the trays would have to provide room behind the tray for the slack of the wire to be stored when the module is fully inserted.

Because of the location of the connectors, it is impractical to visually align module 300 with tray 200 while inserting the module. It is therefore desirable to provide a device and technique to align the connectors blindly.

One prior art device for implementing a blind-mating technique is illustrated in FIG. 4A. Similar to the connectors of FIG. 1, connector 400 contains a flange and a plurality of pins. Corresponding connector 402 also contains a flange and several holes. In order to allow a user to connect the module with the tray without manually manipulating the connectors, connector 402 contains guide pins 410 and 412. The corresponding connector contains through holes 414 and 416 that align with guide pins 410 and 412, respectively. The guide pins may or may not be tapered such that the end that first comes into contact with the through holes is the narrowest portion and the pin is thicker closer to connector 402. As guide pins 410 and 412 first contact through holes 414 and 416, the connectors start to become aligned with each other. As the connectors are pushed towards each other, the thicker portion of the guide pins is in contact with through holes 414 and 416. The thicker portion of the guide pins has less freedom of movement within through holes 414 and 416. Thus, there is a closer alignment between the connectors before the respective flanges interconnect.

Connector 400 of FIG. 2 may be rigidly attached to the tray. Thus, connector 402 must move to the position of the connector 400 in order for the connection to occur. Because connector 402 is rigidly attached to the module, the entire module must be moved in order for the connectors to be aligned. Because of manufacturing inefficiencies, there are instances in which such an alignment is not possible.

Float bushings 420 may also be added to connector 400. Float bushings 420 allow connector 400 to move or "float" within certain limits. Thus, the addition of float bushings adds tolerances to the connector system. Instead of only moving connector 410 to align with connector 400 as with the system without the float bushings, both connectors 400 and 410 move with respect to each other to establish a connection.

While the addition of float bushings 420 allows movement in two mutually perpendicular directions, there is no provision for movement in the front-back direction, the direction of the insertion of the module. This can lead to some problems with misalignment. Because of manufacturing tolerances, the front-back dimension of the modules are not always the same. Therefore, when a module is inserted into a tray, there may be a portion of the front of the module (the "bezel") that protrudes from the face of the tray. Furthermore, there may be a situation where the module, when inserted fully into the tray, is not as long as required. Therefore, the connectors may not fully engage with each other and are more easily disconnected from one another due to vibrations, movement, accidental bumping, etc.

In addition, the use of float bushings may result in a connector that is no longer centered within its mounting holes. Because a typical tray and module are mounted such that the connectors are vertically oriented, the float bushings tend to settle at the bottom of the hole in which it is mounted.

With reference to FIG. 4B, float bushing 450 rests within mounting hole 452. A connector would be mounted by a bolt through the center of float bushing 450. It is evident that the float bushing configuration is merely the placement of a bushing in a mounting hole that is larger than the float bushing. The float bushing thus has the capability to move throughout the mounting hole. However, because of gravity, float bushing 450 rests at the bottom of mounting hole 452. The result of this phenomenon is that there is no freedom of movement towards the bottom of mounting hole 452. Thus, when guide pins 410 and 412 are inserted into guide holes 414 and 416, the freedom of movement of connector 420 is limited.

For the foregoing reasons, there is a need for a connector setup that allows users to insert a module into a tray without having to manually connect the cables. There is also a need for a connector setup in which there is no need to pull the wiring harness out of the tray to establish a connection.

SUMMARY

The present invention is directed to an apparatus that satisfies those and other needs. An apparatus having features of the present invention includes a tray containing a rear hole. There is also a fastener mounted in the rear hole with a spring mounted on the fastener. A mounting plate is further attached to a connector and the mounting plate is mounted on the fastener and the spring.

The fastener may be set up such that the fastener floats within the rear hole by having a fastener which is smaller than the rear hole.

There may also be a guide pin located on the rear plate.

A module having features of the present invention for insertion into the tray contains a connector and a guide hole located in proximity to the connector. Ideally, the guide hole is configured such that the insertion of the module into the tray results in the guide hole interfacing with the guide pin.

An alternative embodiment of the present invention contains guide pins on the module. Then the tray contains mounting holes located on the mounting plate. Therefore, the guide pins on the connector of the module interface with the guide holes on the connector of the tray.

BRIEF DESCRIPTION OF THE DRAWINGS

The features, aspects, and advantages of an embodiment of the present invention will become better understood with reference to the following description, appended claims, and drawings, where like reference numbers depict like elements, in which:

DETAILED DESCRIPTION

The novel features of the present invention will become apparent to those of skill in the art upon examination of the following detailed description of the invention or can be learned by practice of the present invention. It should be understood, however, that the detailed description of the invention and the specific examples presented herein, while indicating certain embodiments of the present invention, are provided for illustration purposes only, because various changes and modifications that are within the scope of the invention will become apparent to those of skill in the art from the detailed description of the invention and claims that follow.

Figure 5B:
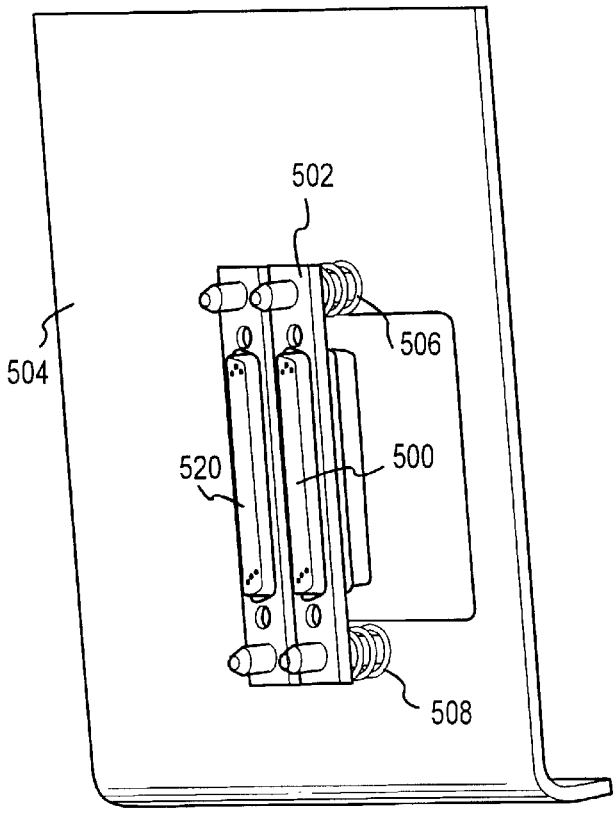
FIGS. 5A and 5B depict a rear plate located at the rear of a tray, upon which connectors can be mounted.
Figure 5A:
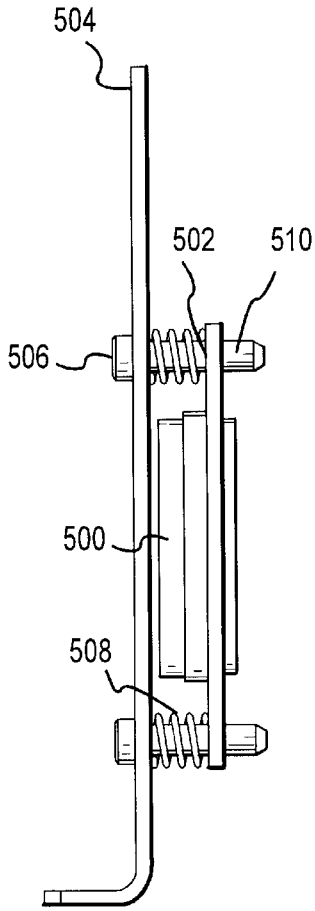

FIG. 5A shows a side view of an exemplary rear plate of a tray containing an exemplary embodiment of the present invention. Connector 500 is attached to a mounting plate 502. Connector 500 may be a D-sub connector or it may be various other types of connectors used to electrically couple a module to a tray. Mounting plate 502 may be constructed out of a metal. Mounting plate 502 is used to secure connector 500 to a tray: connector 500, by itself, typically contains no mechanism to allow securing to a tray. Mounting plate 502, as illustrated, is rectangular, however, it should be realized that various shapes of mounting plate 502 may be used.

Mounting plate 502 is connected to the main rear plate 504 via shoulder bolt 506. Mounting plate 504 is typically the rear surface of the tray, upon which connectors are located.

Spring 508 is suitably placed on the shoulder bolt between mounting plate 502 and main rear plate 504. Spring 508 is depicted as being a coil spring in FIGS. 5A and 5B, however, other forms of springs, such as rubber bushings, leaf springs, pneumatic springs, etc., may be used. Mounted on top of the shoulder bolt over the mounting plate is a guide pin 510. Guide pin 510 is tapered such that one end has a smaller diameter than the other end. The end with the smaller end is the end farthest away from the mounting plate 502. Guide pin 510 may be configured such that it is threaded. Therefore, guide pin 510 may be threaded onto shoulder bolt 506. In this manner mounting plate 502 is secured onto shoulder bolt 506.

An orthogonal view of a rear plate of a tray is shown in FIG. 5B, with connector 520 shown in addition to connector 500, mounted in a similar manner. It should be remembered that a typical tray may contain multiple connectors.

Figure 6:
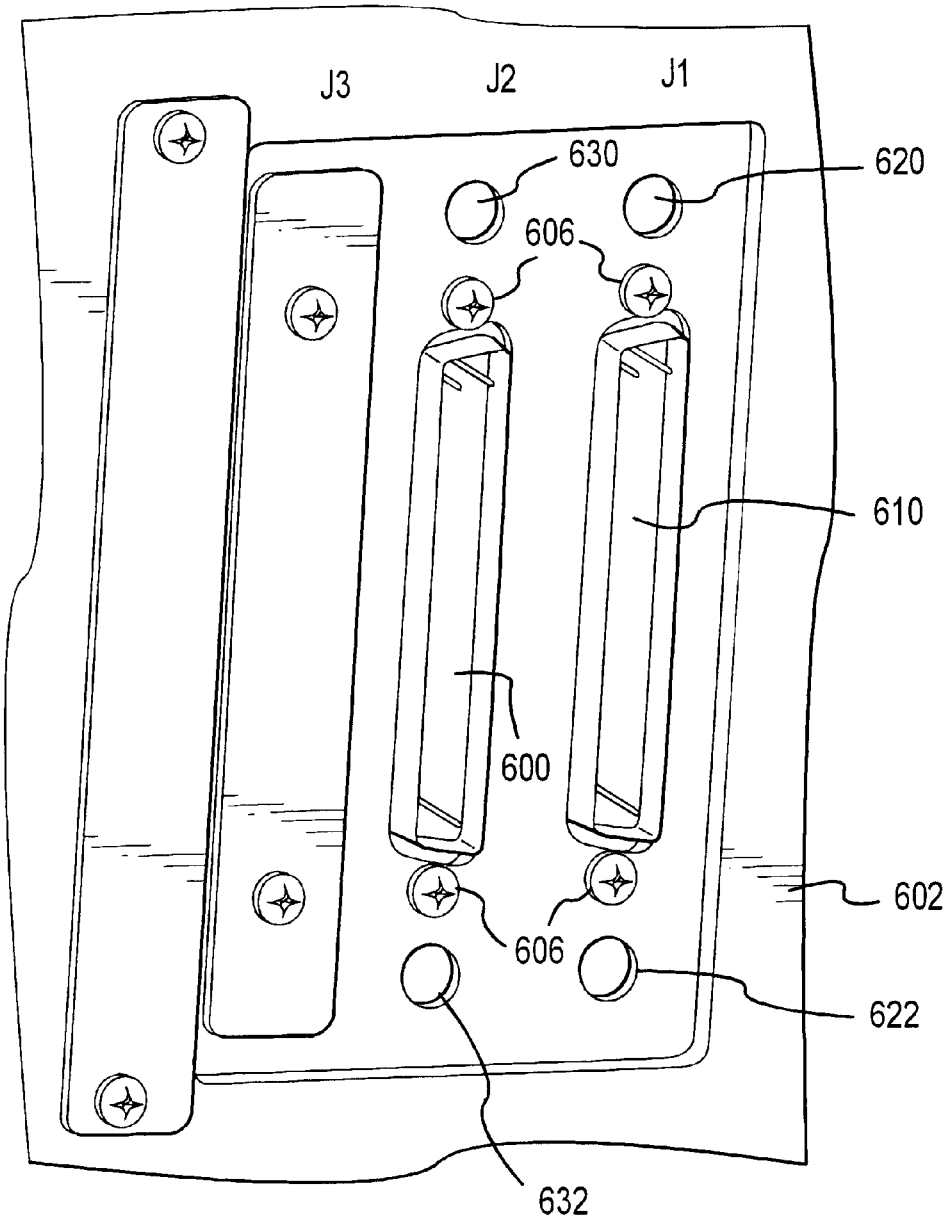
FIG. 6 shows a portion the rear of a module containing the connectors that couple with the connectors shown in FIGS. 5A and 5B.

FIG. 6 illustrates a portion of panel face 602 that mates with the rear plate 400 of FIG. 5B. Connector 600 is a connector that connects to connector 500 of FIG. 5A. For example, if connector 500 is a female D-sub connector, connector 600 would be a male D-sub connector.

Connector 600 is mounted on the panel face in any of several different manners. For example, connector 600 may be affixed into panel face 602 with several screws 606, as illustrated in FIG. 6, or connector 600 may be riveted into panel face 602. Guide hole 630 is drilled into the mounting plate at a location such that, when the module is inserted into the tray, guide pin 510 interfaced with guide hole 630. Guide holes 620, 622, and 632 are drilled in a similar manner to correspond to other guide pins.

An exemplary system of an embodiment of the present invention operates in the following manner. The module with panel face 600 is inserted into the tray. As the module is further inserted into the tray, guide pin 510 engages with guide hole 630. The connector setup of the mounting plate 502, connector 500, shoulder bolt 506, and spring 508 may be configured such that the connector setup "floats". Connector 600 and connector 500 do not have to be perfectly aligned with each other because connector 500 is free to move in three mutually-perpendicular directions (up-down, left-right, and front-back). The length of guide pin 510 is chosen such that guide pin 510 engages with guide hole 630 before connector 500 and connector 600 engage with each other. Therefore, guide pin 510 may protrude from mounting plate 502 to a greater extent than connector 500 protrudes from mounting plate 502.

This additional degree of freedom allows connectors 500 and 600 to mate even if the module upon which connector 600 resides is slightly longer or shorter than what is nominal.

Figure 1:
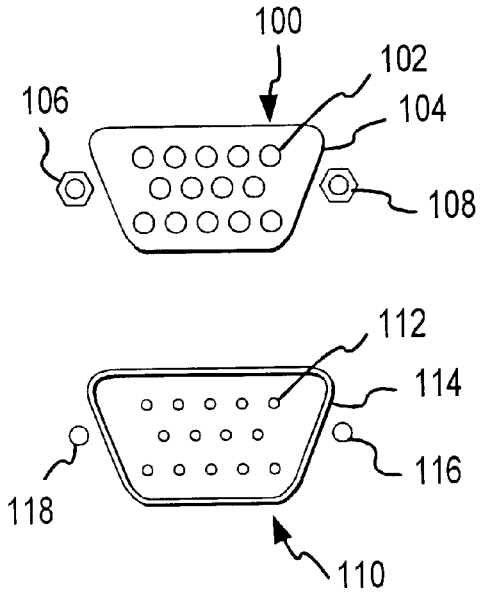
PRIOR ART FIG.1
FIG. 1 depicts a pair of D-sub connectors.
Figure 2:
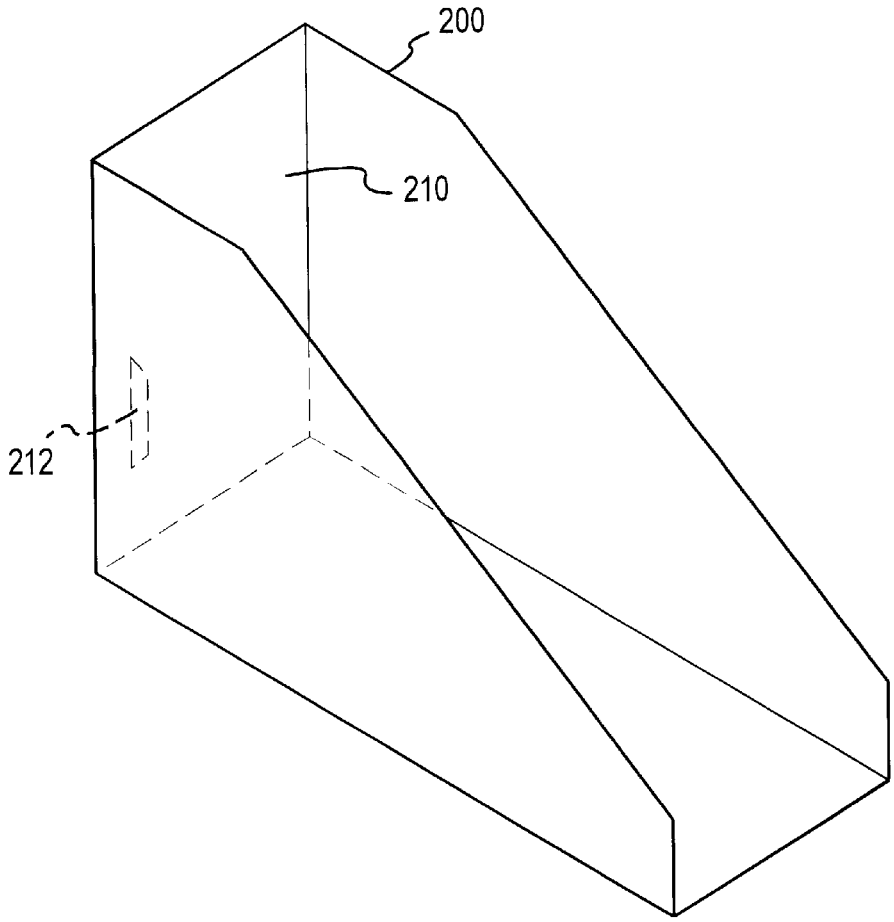
FIG. 2 illustrates an exemplary tray and the placement of the connectors on the tray.
Figure 3:
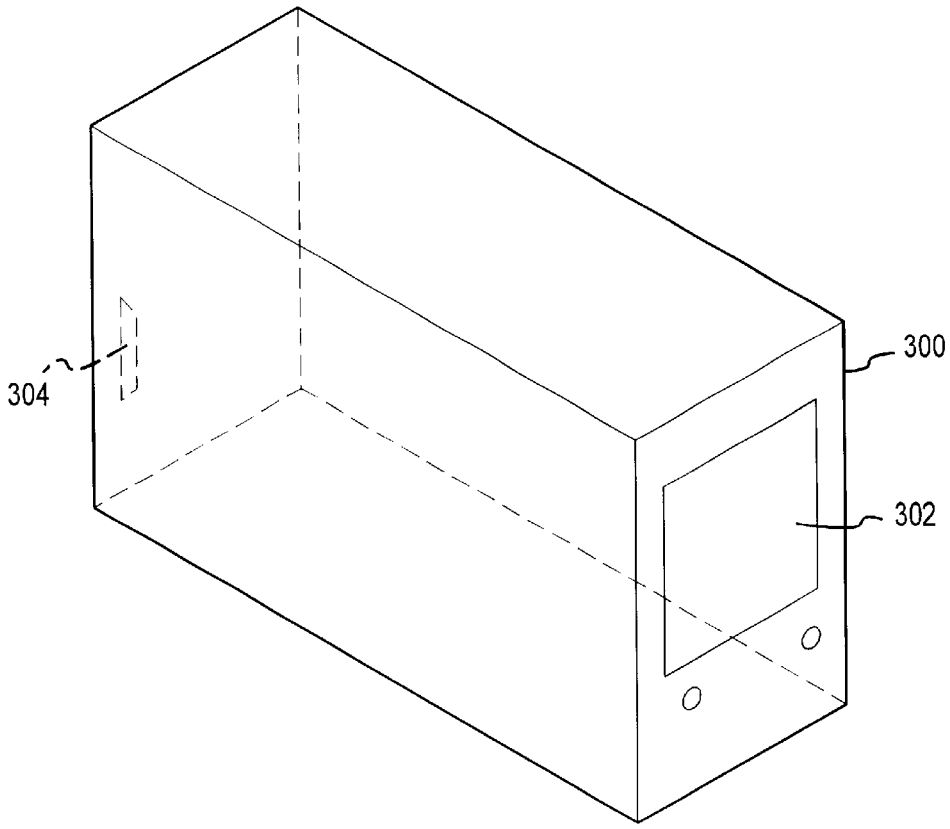
FIG. 3 shows an exemplary module for insertion into the tray of FIG. 2.
Figure 4A:
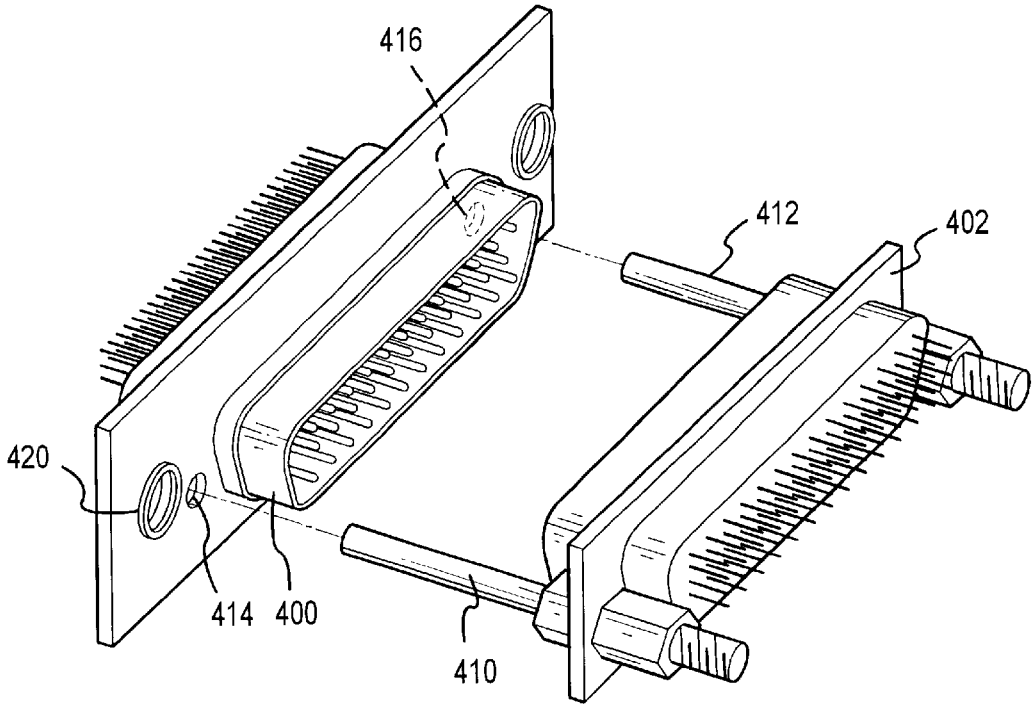
PRIOR ART FIG.4A
FIGS. 4A and 4B depict an exemplary blind-mating system.
Figure 4B:
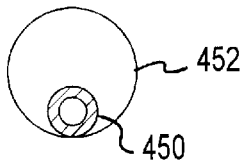

Spring 508 has several other functions as well. When a floating bushing as in FIG. 4A and FIG. 4B is used, the connector tends to settle at the bottom of its possible locations, as explained above. The system shown in FIG. 5 alleviates that problem: the spring tension forces that mounting plate and connector to be centered in the hole in which the shoulder bolt is mounted.

The system of FIG. 5 has a further advantage: as the module is being inserted into the tray, the guide pin 510 connects with the guide hole 630. Then the flanges of connectors 500 and 600 engage. By this time, the two connectors have been aligned by guide pin 510 and guide hole 600 such that the flanges are in alignment. As the pins and slots of connectors 500 and 600 engage, spring 508 helps make the connection by pushing the two connectors towards each other.

The use of the spring has a further advantage. In a vibration-prone environment, such as an airplane cockpit, the connectors may have a tendency to disconnect from each other. If the connectors are screwed together, there is no such problem, however, in a blind mating context, it is very difficult and inconvenient to screw the connectors together. The spring provides a force that keeps the connectors together and gives the connectors freedom of movement so the module can move within the tray while still maintaining connection.

Figure 7:
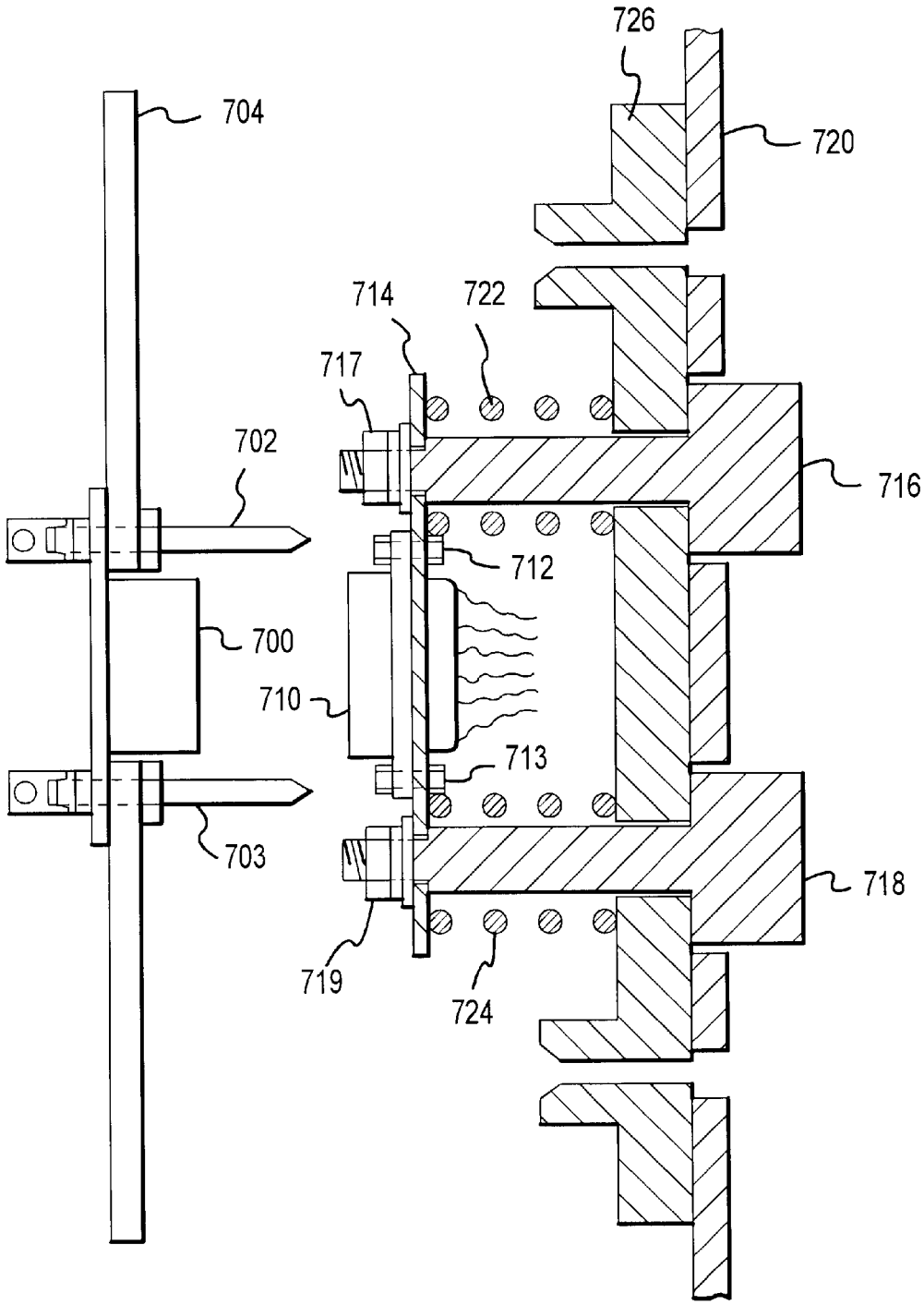
FIG. 7 shows an alternative embodiment of the connector setup system.

FIG. 7 shows an alternative embodiment of the present invention. In this embodiment, the locations of the guide pins and the guide holes are reversed. The guide pins are located on the modules and the guide holes are located on the mounting plate.

More specifically, guide pins 702 and 703 are mounted on the rear of module 704 that is inserted into the tray Guide pins 702 and 703 are astride connector 700 and may protrude from rear plate 704 to a greater extent than does connector 700 so as to interface with guide holes 712 and 713 before connector 700 interfaces with connector 710. Connector 700 and connector 710 are analogous to connectors 500 and 600 of FIG. 5 and FIG. 6. Guide pins 702 and 703 are analogous to guide pins 510.

The tray may be configured as follows. Connector 710, which connects with connector 700, is mounted on mounting plate 714. On either side of connector 710 are guide holes 712 and 713, which accept guide pins 702 and 703, respectively. Guide holes 712 and 713 may be configured such that guide holes 712 and 713 also serve to secure connector 700 to mounting plate 714.

Mounting plate 714 is attached to guide pin block 726 with shoulder bolts 716 and 718. Nuts 717 and 719 secure mounting plate 714 to bolts 716 and 718. Mounting plate 714 is configured similarly to mounting plate 502 of FIG. 5. Springs 722 and 724 are shown mounted on the shoulder bolts in between mounting plate 714 and guide pin block 726. Guide pin block 726 rests on rear plate 720 of the tray. Guide pin block 726 is a representation of a main structural rear support analogous to rear main plate 504 illustrated in FIG. 5.

The operation of this embodiment is analogous to the operation of the embodiment described above. When the module is inserted into the tray, guide pins 702 and 703 engage guide holes 712 and 713. The interaction between guide pins 702 and 703 and guide holes 712 and 713 aligns connector 700 and connector 710. Therefore, as the module is inserted further into the tray, connector 700 aligns with connector 710 so that the connectors attach to each other as appropriate. Springs 722 and 724 help to provide the connective force necessary to seat the connectors with each other as well as allowing connector 710 to float to a more appropriate position to connect with connector 700.

The above description presents exemplary modes contemplated in carrying out the invention. The techniques described above are, however, susceptible to modifications and alternate constructions from the embodiments shown above. Other variations and modifications of the present invention will be apparent to those of ordinary skill in the art, and it is the intent of the appended claims that such variations and modifications be covered. For example, while the invention has been described with respect to D-sub connectors, it should be appreciated that this invention can operate with any type of connector of any shape, such as a round connector or a rectangular connector, PCMIA-type connections, ARINC style connections, IEC-power connectors, or any other type of connector. Furthermore, while this invention has been described with respect to aircraft equipment, it should be appreciated that the present invention will operate in any type of environment where blind mating is desirable, including, but not limited to, other types of rack mounting; computer servers; dashboards of cars, trucks, and boats; laptop compuer docking stations; communication equipment; cellular phone chargers, and the like. In addition, it should be understood that the various parts of the present invention can be made with a number of different materials, including, but not limited to, stainless steel and aluminum, without effecting the operability of the invention.

Consequently, it is not the intention to limit the invention to the particular embodiments disclosed. On the contrary, the invention is intended to cover all modifications and alternate constructions falling within the scope of the invention, as expressed in the following claims when read in light of the description and drawings. No element described in this specification is necessary for the practice of the invention unless expressly described herein as "essential" or "required."

What is claimed is:

1. An apparatus for mounting a connector to a tray comprising:

a rear plate of said tray, with a first rear hole;

a first fastener mounted in said first rear hole;

a first spring mounted on said first fastener;

a mounting plate attached to the connector, wherein said mounting plate is mounted on said first fastener and said first spring; and a first guide pin mounted on said mounting plate and on said first fastener so as to secure the mounting plate to said first fastener.

2. The apparatus of claim 1 wherein the diameter of said first fastener is smaller than said the diameter of said first rear hole such that said first fastener floats within said first rear hole.

3. The apparatus of claim 1 wherein said first guide pin is tapered.

4. The apparatus of claim 1 wherein said guide pin protrudes from said mounting plate to a greater extent than said connector protrudes from said mounting plate.

5. The apparatus of claim 1 wherein said first spring is a coil spring.

6. The apparatus of claim 5 wherein said first spring is coaxial with said first fastener.

7. The apparatus of claim 1 further comprising first and second guide holes located on said mounting plate.

8. The apparatus of claim 7 wherein said first and second guide holes are located astride said connector.

9. The apparatus of claim 1 wherein said rear plate of said tray further comprises a second rear hole, said apparatus further comprising a second fastener mounted in said second rear hole;

a second spring mounted on said second rear hole; wherein said mounting plate is mounted on said first and second fasteners and said first and second springs.

10. The apparatus of claim 9 wherein the diameter of said first fastener is smaller than said the diameter of said first rear hole such that said first fastener floats within said first rear hole; and the diameter of said second fastener is smaller than said the diameter of said second rear hole such that said second fastener floats within said second rear hole.

11. The apparatus of claim 9, further comprising a guide pin block, wherein said first and second fasteners are mounted in said guide pin block; and said guide pin block is mounted to said rear plate.

12. The apparatus of claim 9 further comprising a first guide pin and a second guide pin, wherein said first and second guide pins are mounted on said mounting plate; and wherein said first and second guide pins protrude from said mounting plate to a greater extent then said connector protrudes from said mounting plate.

13. The apparatus of claim 12 wherein said first and second guide pins are tapered.

14. The apparatus of claim 9, wherein said first fastener comprises a first bolt; and said second fastener comprises a second bolt.

15. The apparatus of claim 14, wherein said first bolt comprises a first shoulder bolt; and said second bolt comprises a second shoulder bolt.

16. The apparatus of claim 14, wherein said mounting plate comprises a first mounting hole and a second mounting hole;

said mounting plate is mounted on said first bolt and said second bolt such that said first bolt is positioned through said first mounting hole; and said second bolt is positioned through said second mounting hole.

17. An apparatus for mounting a connector to a tray comprising:

a rear plate of said tray, with a first rear hole and a second rear hole;

a first fastener mounted in said first rear hole;

a first spring mounted on said first fastener;

a mounting plate attached to the connector, said mounting plate comprising a first mounting hole and a second mounting hole;

a second fastener mounted in said second rear hole;

second spring mounted on said second rear hole;

a first guide pin; and a second guide pin;

and wherein, said first fastener comprises a first bolt;

said second fastener comprises a second bolt;

said mounting plate is mounted on said first and second bolts and said first and second springs, such that said first bolt is positioned through said first mounting hole;

said second bolt is positioned through said second mounting hole;

said first guide pin and second guide pin are each threaded;

said first guide pin is threaded on said first bolt;

said second guide pin is threaded on said second bolt; and wherein said first guide pin and said second guide pin secure said mounting plate to said first bolt and said second bolt.

* * * * *

UNITED STATES PATENT AND TRADEMARK OFFICE

CERTIFICATE OF CORRECTION

PATENT NO. : 6,592,387 B2
APPLICATION NO. : 09/749370
DATED : July 15, 2003
INVENTOR(S) : Vernon A. Komenda, John H. Eller, Jr. and Gary O. Larson It is certified that error appears in the above-identified patent and that said Letters Patent is hereby corrected as shown below:

On Title page
Item (22): December 22, 2000

Signed and Sealed this

Twenty-second Day of January, 2008

JON W. DUDAS
*Director of the United States Patent and Trademark Office*